United States Patent [19]

Teschner

[11] 4,123,032

[45] Oct. 31, 1978

[54] ARRANGEMENT FOR ENCASING STEEL CONCRETE CEILINGS PROVIDED WITH TRUSSES

[75] Inventor: Horst Teschner, Lichtendorf, Fed. Rep. of Germany

[73] Assignee: Ingenium Ingenieurgesellschaft für Mehrzweckbauten, Industrieanlagen und Geländenutzung mbH Bau-Kommanditgesellschaft, Schwerte-Lichtendorf, Fed. Rep. of Germany

[21] Appl. No.: 813,100

[22] Filed: Jul. 5, 1977

[51] Int. Cl.[2] ..... E04G 11/46

[52] U.S. Cl. ..... 249/29; 249/18; 249/210

[58] Field of Search ..... 249/13, 18, 28–32, 249/210, 212

[56] References Cited

U.S. PATENT DOCUMENTS

| | | | |
|---|---|---|---|
| 2,894,312 | 7/1959 | Jones et al. | 249/28 |
| 3,845,930 | 11/1974 | Metrailer | 249/29 |

FOREIGN PATENT DOCUMENTS

| | | | |
|---|---|---|---|
| 1,109,183 | 4/1968 | United Kingdom | 249/212 |

*Primary Examiner*—Francis S. Husar
*Assistant Examiner*—John McQuade
*Attorney, Agent, or Firm*—Max Fogiel

[57] ABSTRACT

An arrangement for encasing ceilings with trusses in which a framework of four telescopic supports and strengthened by struts, holds casing beams having two sides on which telescopic ceiling casing carriers are located. The framework provides for supporting the casing for the trusses, and at least two trusses are placed a distance apart and adjacent from each other. Between the casing beams and the supports, beam support carriers are telescoped on both ends and combined into a fixed-angle frame detachably and tension-proof connected to the supports. The support carriers, furthermore, support abutments bridging a space between the casing tables for the truss casing carriers. Four intermediate supports are detachably fastened to the beam support carriers, and the casing beams which support the ceiling casing carriers and which are combined with the ceiling casing carriers into a rigid-angle frame, are fastened to the four intermediate supports. Beam support carriers are made of rectangular pipes with four detachable inserts, and are fixed in relation to the beam support carriers while being movable. The abutments are movable, moreover, in infinitely variable steps on the beam support carriers for lateral beam casings. The intermediate supports are fastened to the beam support carriers with infinitely variable height adjustment. The intermediate supports are detachably connected to the casing beams.

11 Claims, 14 Drawing Figures

ARRANGEMENT FOR ENCASING STEEL CONCRETE CEILINGS PROVIDED WITH TRUSSES

BACKGROUND OF THE INVENTION

The present invention relates to an arrangement or device for encasing ceiling with trusses; the arrangement comprises a framework of four telescopic supports, and is strengthened by struts; the framework holds casing beams on both whose sides telescopic ceiling casing beams are located, and has means for supporting the casing for the trusses of which at least two are placed a distance apart and adjacent from each other.

Such a device has been described in German Utility Pat. No. 1 943 615. With the known design, the casing for the trusses is supported by angle sections which are attached to the framework supports via spindles forming cantilevers. In order to absorb the forces arising when pouring concrete, both the angle irons and the spindles as well as the supports would have to be so heavy that the device can no longer be handled. Even then the design would require that the same amount of fresh concrete is poured in all truss casings of a concrete slab at the same time, since the frameworks otherwise would slide away or tilt under the horizontal forces emanating from the concrete. However, a simultaneous pouring of all truss casings of a concrete slab is not possible.

There has already been proposed a casing framework (French Pat. No. 1 598 062) where the truss casing is supported by truss casing carriers fixed by spaced adjacent case frameworks and which is supported via wedges against the framework supports. Thus the forces occuring during concrete pouring are controlled; the design solution, however, involves considerable expenditure of time for assembly and disassembly and particularly when relocating the frame from one concrete slab (section) to another, since the truss casing carrier must be solidly fastened to the supports. In addition, the infinetely variable adaption of the truss casing to different truss dimensions is difficult.

Both with the design according to German Utility Pat. No. 1 943 615 and according to French Pat. No. 1 598 062, the arrangement of supports for the truss casing on the framework supports is fixed and their arrangement is possible only in line with these supports. Hence the carrying capacity of the truss casing or the dimensioning of the trusses is limited from the outset. However, even with a limited variation of the truss dimensions, it becomes necessary to adapt the bottom supports for the truss casing to the load by varying the cross-section. Both known methods do not permit the crossing of trusses.

Accordingly, it is an object of the present invention to provide a movable casing device which is completely recoverable, has a large variation regarding ceiling height, ceiling length and ceiling width and truss height and truss width, and makes possible to production of horizontal carrying structures with crossing trusses.

Another object of the present invention is to provide an arrangement of the foregoing character which is substantially simple in construction and may be readily maintained in service.

A further object of the present invention is to provide an arrangement, as described, which may be economically produced, and which has a substantially long service life.

SUMMARY OF THE INVENTION

The objects of the present invention are achieved by providing that between the casing beams and the supports, telescoped beam support carriers are combined into a fixed-angle frame, and are detachably and tension-proof connected to the supports; these support carriers support abutments bridging the space between the casing tables for the truss casing; four intermediate supports are detachably fastened to the beam support carriers; the casing beams which support the ceiling casing carriers and are combined with the ceiling casing carriers into a rigid-angle frame are fastened to these four supports.

The beam support carriers, in accordance with the invention, inserted into the casing table and combined into a rigid-angle frame, permit the location of as many truss casing carriers as necessary for the special truss. The height of the lateral truss casing can be varied by displacing the intermediate supports, in width by changing the distance of the spacing of the casing tables, as well as by suitable telescoping of casing beams and/or ceiling casing carriers, whereby the required angle to produce the trough shape, facilitating encasing, of the truss casing can be produced. The horizontal forces arising when pouring concrete for the trusses are received, via the abutments belonging to the truss casing carriers, directly by the truss casing carriers where they are balanced. In addition, the new casing table permits, for the first time, the production of a horizontal carrying frame with crossing trusses by means of a movable casing. After lowering the casing tables, relocating the casing tables merely requires displacing the truss casing carriers on one of the casing tables. The casing table in accordance with the present invention can easily be converted into a pure ceiling casing table.

The novel features which are considered as characteristic for the invention are set forth in particular in the appended claims. The invention itself, however, both as to its construction and its method of operation, together with additional objects and advantages thereof, will be best understood from the following description of the specific embodiments when read in connection with the accompany drawings.

DESCRIPTION OF THE PREFERRED EMBODIMENTS

Figure 1:
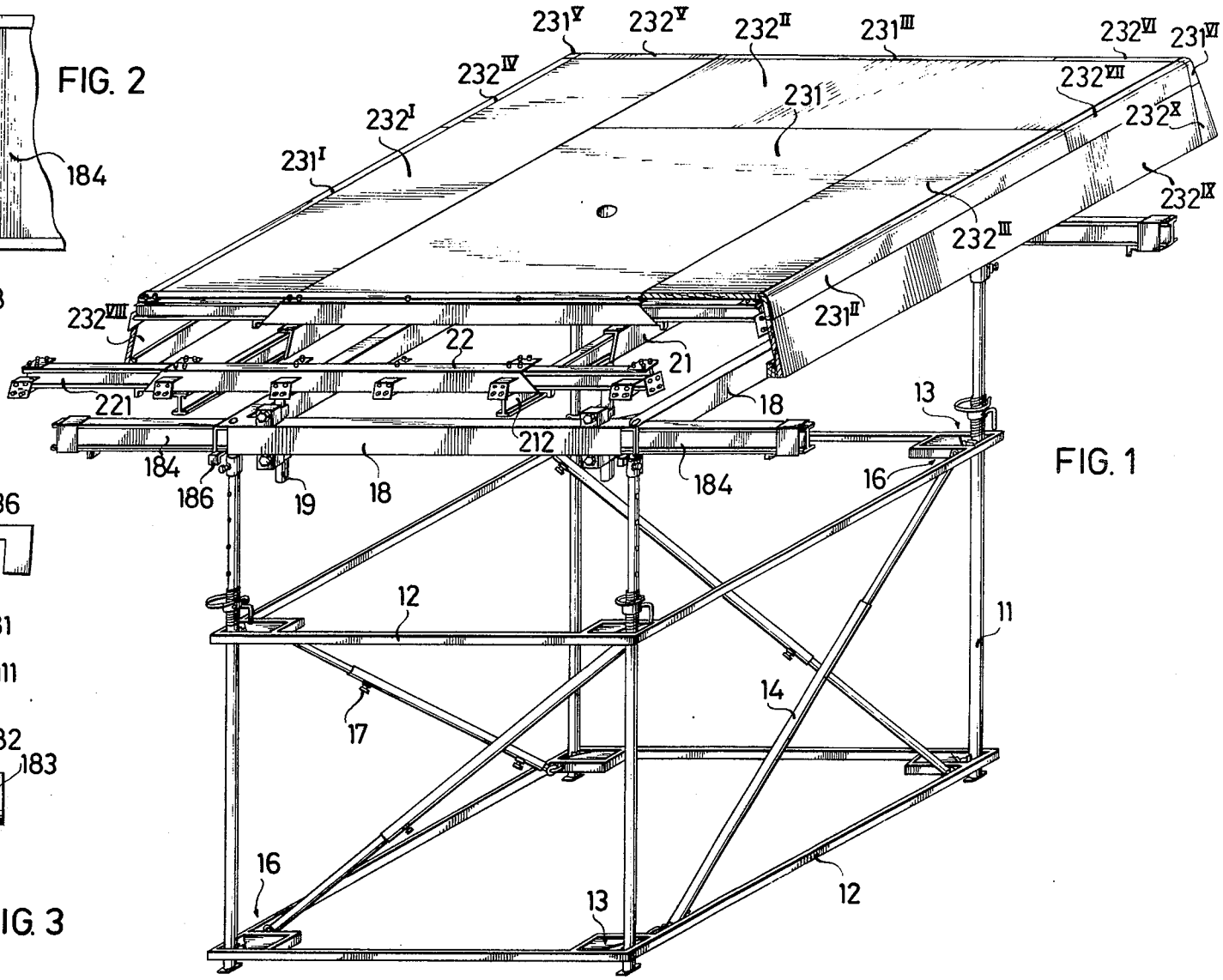
FIG. 1 shows a casing table in accordance with the present invention.
Figure 2:
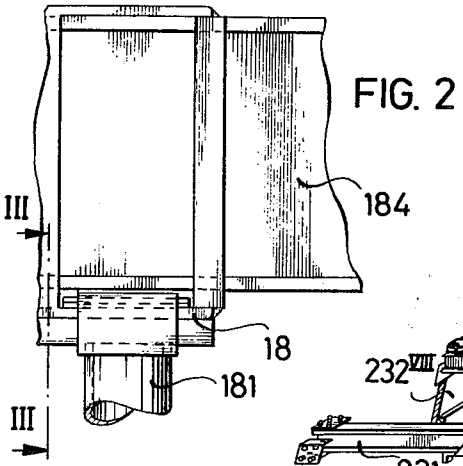
FIG. 2 shows the forward right-hand joint support beam support carrier as seen when viewing the plane of FIG. 1.

The foundation of the casing tables comprises four telescopic supports 11 which are fixed in the corners of spaced horizontal frames 12 in FIG. 1. For stiffening purposes, diagonal struts 14 extend between the horizontal frames; these struts also are detachable (16 and 17).

Figure 13:
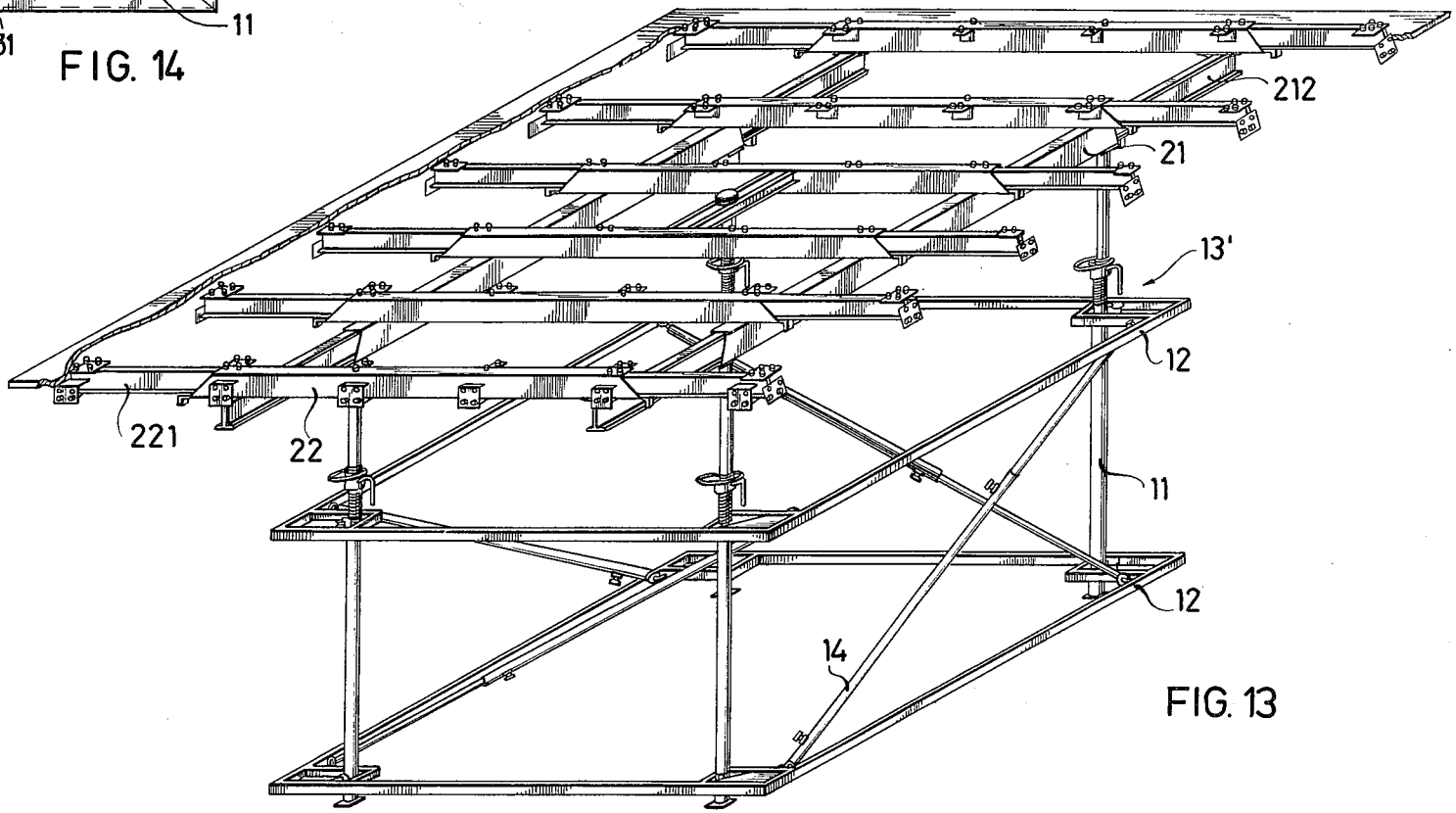
FIG. 13 shows pure ceiling casing table which can be realized with the design.
Figure 14:
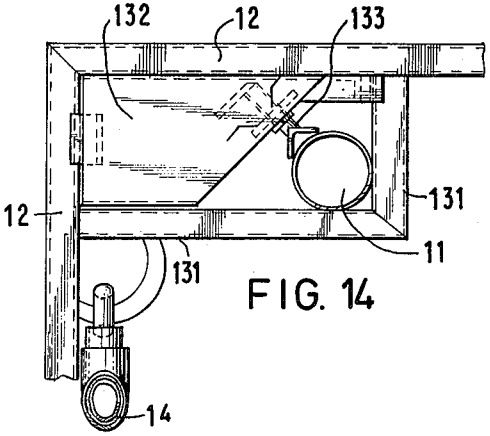
FIG. 14 shows a corner of the foundation for the ceiling casing table in a top view.

The fixing of supports 11 in the corners of frame 12 is denoted by 13 in FIG. 1 or by 13' in FIG. 13. FIG. 14 shows more clearly how the fixing is accomplished. Into frame corner 12, 12, a bearing 131, 131 is welded into which a clamping piece 132 has been inserted in a detachable manner; this clamping piece mounts a tightening screw 133 which is tightened against support 11.

Figure 3:
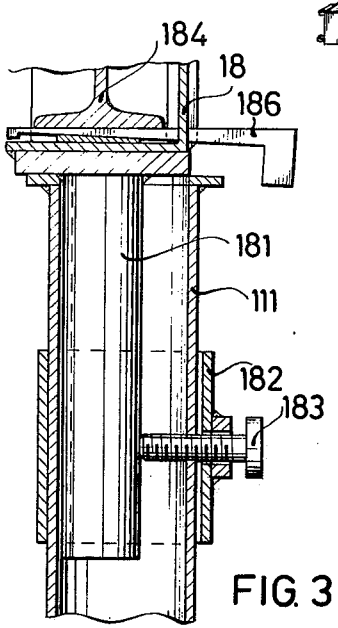
FIG. 3 shows a section taken along line III—III in FIG. 2.

At the free end 111 of the telescopic struts 11 the angle-rigid frame, formed by beam support carriers 18, can be fixed by means of plug pipes 181, which are welded to the bottom side of carriers 18 and are insertable into the telescope supports 11; the plug pipes 181 can be made tension-proof in relation to the telescopic supports by means of clamp screws 183 threaded to sleeves 182 leading to the telescopic supports 11 (FIG. 3).

The frame formed by beam support carriers 18 is provided with inserts 184 of which on one frame corner, only one can be inserted into the frame legs (18) either in one or the other direction. The inserts 184 are held in the desired position by means of wedges 186 (FIG. 1).

Figure 4:
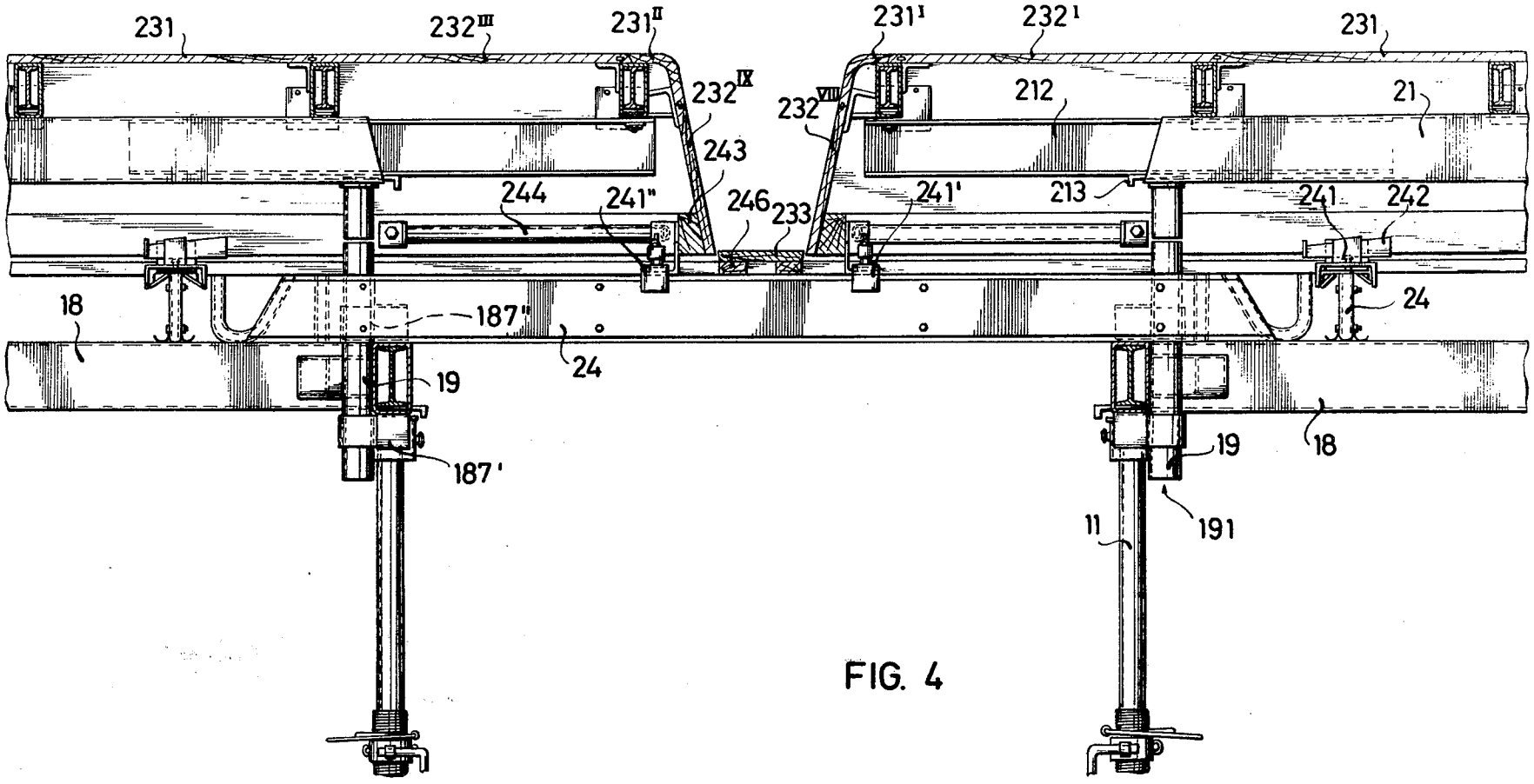
FIG. 4 shows a section through the upper portion of two adjacent casing tables.
Figure 6:
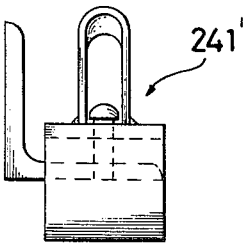
FIG. 6 shows the view of the abutment in the direction of arrow VI in FIG. 5.
Figure 7:
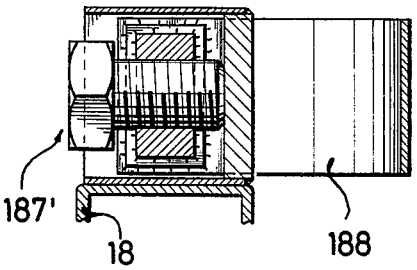
FIG. 7 shows the clamp for fixing the intermediate sections on the beam support carriers in a vertical section.
Figure 8:
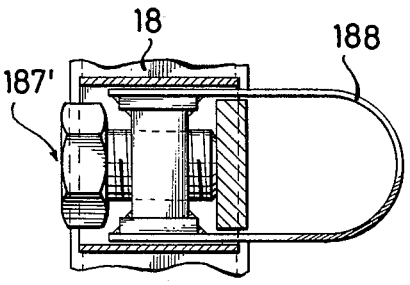
FIG. 8 shows the top view of the clamp, partially in section.

At the top and bottom side of the beam support carriers 18, there are flush tension locks 187', 187'' for clamp straps 188 for holding the infinitely variable intermediate supports 19 which extend between the beam support carriers 18 and the casing beams 21 (FIGS. 4, 7 and 8).

Figure 10:
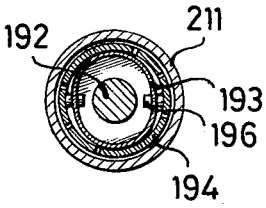
FIG. 10 shows a section taken along line X—X in FIG. 9.
Figure 9:
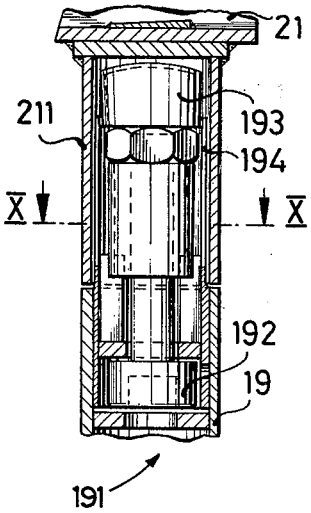
FIG. 9 shows a vertical section through the connection between intermediate support and casing beam.

The intermediate support 19 is formed by a pipe in which the adjusting means 192 of a gripping cone 193 lead from the intermediate support 19; this gripping cone is detachably grasped by a sleeve 211 welded to the casing beam 21 with which a slotted casing pipe 194 makes force-locked contact under the influence of the non-rotatingly (196) guided cone (FIGS. 9 and 10). If a square pipe is used, special measures for preventing rotation are not required. The adjusting means 192 are accessible from the lower free end 191 of the intermediate support.

The casing beams 21 in turn are provided on both sides with telescopic inserts 212 which can be fixed in the desired position. The fixing of the inserts 212 is again achieved with clamping wedges 213.

Casing beams 21 and associate ceiling casing carriers 22, provided on both sides with telescopic inserts 221, form a construction unit which is associated from the outset with a basic casing 231 to be supplemented by a difference casing 232 designed for the specific case.

The difference casing 232 comprises fitting elements and these are comprised of supplementary casing plates 232' to 232''' supplementary rim casings $232^{IV}$ to $232^{VII}$ and lateral truss casings $232^{VIII}$ to $232^{X}$.'

On the beam support carriers 18, there are truss casing carriers 24 which bridge the space between two adjacent casing tables (FIG. 4); these carriers underpin the truss casing. The truss casing carriers 24 are associated with two infinitely variable displaceable abutments 241', 241'' for the lateral truss casing $232^{VIII}$, $232^{IX}$ which are wedged in the desired position (242).

Figure 5:
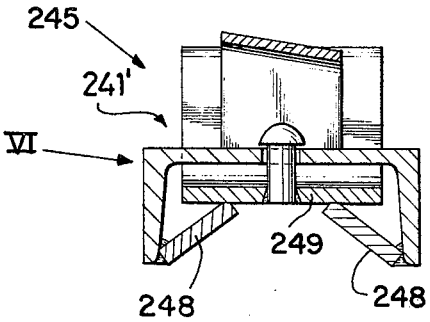
FIG. 5 shows the abutment for the lateral truss casing in a sectional view.
Figure 11:
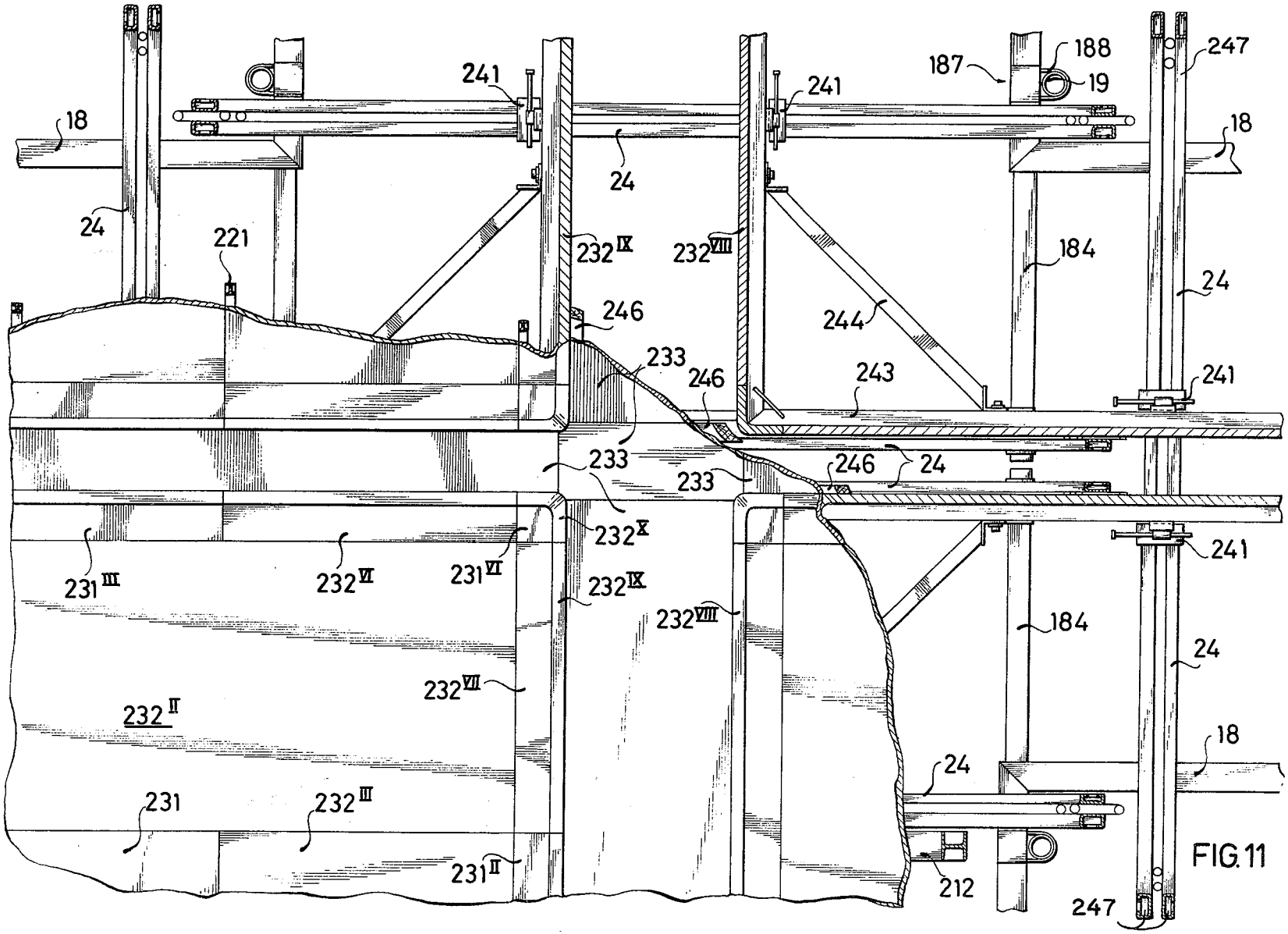
FIG. 11 shows the top view of a concrete slab (section), partially broken open.
Figure 12:
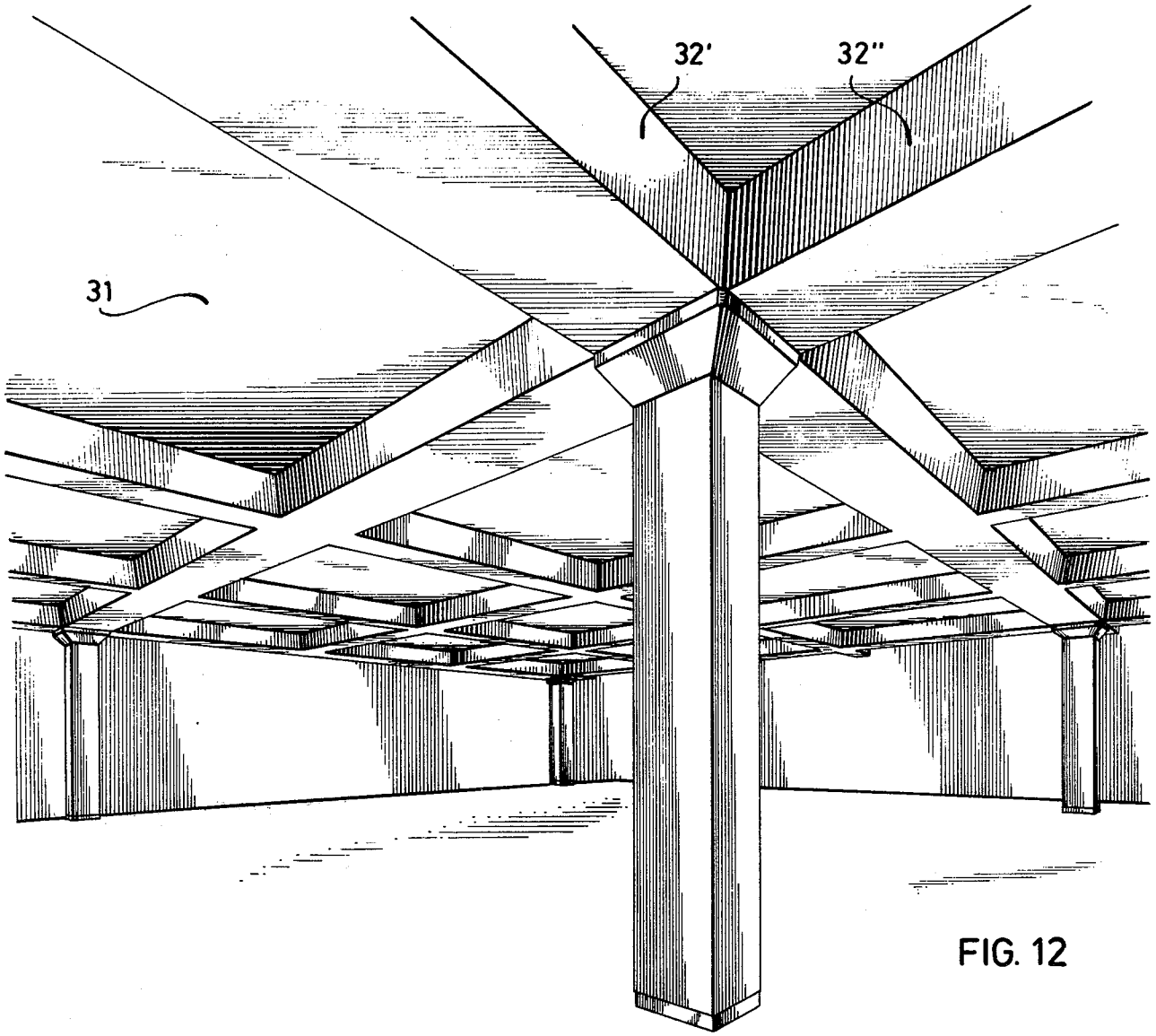
FIG. 12 shows a horizontal carrying frame of steel concrete, produced by means of the device in accordance with the present invention.

The abutments 241', 241'' are movable on truss casing carrier 24 and can be fixed on the truss casing carrier 24 by means of the wedge 242 (FIG. 4) which can be driven into the abutments in the direction of arrow 245 in FIG. 5. The abutments are located on the truss casing carrier 24 in such a way that the legs 247 (FIG. 11) forming the supporting surface fit between the rim portions 248 and the clamping plate 249 which are clamped into the abutment (arrow 245) while the wedge is driven into the abutment (arrow 245).

The lateral truss casing $232^{VIII}$, $232^{IX}$ leans against the abutments 241', 241'' via a frame leg 243 combined into a circumferential stiffened frame by means of corner stiffener means 244. The bottom casing 233 for the trusses is supported by the truss casing carriers 24 via liners 246 resting on them.

The given floor height can be adjusted by the telescopic supports 11 which can be exchanged for extreme cases.

In accordance with the given size of the ceiling areas or fields 31 between the trusses 32', 32'', the inserts 184, 212, 221 of the beam support carriers 18, the casing beams 21 and the ceiling casing carriers 22 are telescoped and positioned.

The width of the trusses 32', 32'' results from the spacing between the casing tables and, possibly, from the positioning of the inserts 212, 221 assigned to the casing beams 21 and the ceiling casing carriers 22. The height of the trusses 32', 32'' can be determined by suitable positioning of the intermediate supports 19 on the beam support carriers 18.

For individual adaptation, the required difference casing 232 is varied from case to case.

The truss casing carriers 24 transmit the perpendicular forces via the beam support carrier 18 to the structures. The forces supplying the tendency for tilting and/or sliding apart are introduced and compensated via the abutments 241', 241'' into the truss casing carriers 24.

For stripping the forms, the structure supports 11 of one casing table are loosened one at a time. If the casing (form) does not detach immediately from the concrete, the construction is pulled downward till the truss casing carriers 24 can be shifted. After shifting the truss casing carriers 24 on one of the casing tables, there is continued lowering of the table as a whole, till it can be moved without further disassembly underneath the trusses 32 to a new concrete section.

The construction according to FIG. 1 can be converted for a ceiling casing (form) in a simple manner into casing tables according to FIG. 13. For this purpose, the frames in which the truss casing carriers 18 are combined as well as the intermediate supports 19, are removed, and the telescopic supports 11 are moved to the corners of the horizontal frames 12 (13' in FIG. 13) so that they line up with the sleeves 211 located on the casing beams 21. The ceiling casing carriers 22 and the casing are located directly on the foundation by placing the sleeves 211, located on the casing beams 21, on the telescopic supports 11.

For shipping, the casing tables are disassembled; the unit casing beam 21, ceiling casing carrier 22 and ceiling casing is merely reduced to the dimension of the basic casing 231, which corresponds roughly to the dimensions of the horizontal frames 12 and is laid out so that street transport is still possible. The frame formed by the beam support carriers 18 and the foundation are disassembled by loosening the telescopic supports 11 and the diagonal struts 14, with the diagonal struts 14 being associated with one or the other horizontal frame 12.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A portable casing table arrangement for encasing ceilings with trusses, comprising: a framework of four telescopic supports and strengthened by struts; casing beams held by said framework; telescopic ceiling casing carriers located on two sides of said casing beams; means on said framework for supporting the casing for the trusses, beam support carriers between said casing beams and said supports and being telescoped on both ends and combined into a fixed-angle frame detachably and tension-proof connected to said supports; truss casing carriers on the beam support carriers having abutments and adapted to bridge a space between adjacent casing table arrangements; for the truss casing said abutments being movable on said truss casing carriers; four intermediate supports detachably fastened to said beam support carriers; said casing beams supporting said ceiling casing carriers and being combined with said ceiling casing carriers into a rigid-angle frame and being fastened to said four intermediate supports.

2. The arrangement as defined in claim 1, wherein said beam support carriers are comprised of rectangular pipes with four detachable inserts fixed relative to said beam support carriers and being movable.

3. The device as defined in claim 1, wherein said abutments are movable in infinitely variable steps on said truss casing carriers.

4. The arrangement as defined in claim 1, including clamp straps enclosing said intermediate supports above and below said beam support carriers and comprising tension locks rigidly connected to said beam support carriers for fastening said intermediate supports to said beam support carriers with infinitely variable height adjustment.

5. The arrangement as defined in claim 1, wherein said intermediate supports are detachably connected to said casing beams.

6. The arrangement as defined in claim 1, wherein said casing beams and said ceiling casing carriers are combined into one unit.

7. The arrangement as defined in claim 1, including a basic casing associated with said ceiling casing carriers and assembled in place by fitting elements; said fitting elements comprising supplementary casing plates, supplementary rim casings and lateral truss casings.

8. The arrangement as defined in claim 7, wherein the lateral truss casing is an integral component of said basic casing and passes continuously into the basic casing.

9. The arrangement as defined in claim 1, including struts supported by said abutments on said truss casing carriers.

10. The arrangement as defined in claim 9, wherein said struts supported by said abutments are combined into a circumferential frame.

11. The arrangement as defined in claim 10, including corner stiffener means on said circumferential frame.

* * * * *